US008809707B2

(12) United States Patent
Wildman

(10) Patent No.: US 8,809,707 B2
(45) Date of Patent: Aug. 19, 2014

(54) COMBINATION PRESSURE SWITCH WITH MANUAL SHUTOFF

(75) Inventor: Craig R. Wildman, Charlotte, NC (US)

(73) Assignee: Condor-Werke Gebr. Frede GmbH & Co. KG., Ennigerloh (DE)

( * ) Notice: Subject to any disclaimer, the term of this patent is extended or adjusted under 35 U.S.C. 154(b) by 553 days.

(21) Appl. No.: 13/168,503

(22) Filed: Jun. 24, 2011

(65) Prior Publication Data

US 2011/0253515 A1 Oct. 20, 2011

Related U.S. Application Data

(63) Continuation-in-part of application No. 12/173,834, filed on Jul. 16, 2008, now Pat. No. 8,044,310.

(51) Int. Cl.

| | |
|---|---|
| ***H01H 35/24*** | (2006.01) |
| ***F04B 49/02*** | (2006.01) |
| ***F04B 49/03*** | (2006.01) |
| ***F04B 41/02*** | (2006.01) |
| *H01H 35/34* | (2006.01) |

(52) U.S. Cl.

CPC ..... *F04B 41/02* (2013.01); *F04B 49/03* (2013.01); *H01H 35/34* (2013.01); *F04B 49/022* (2013.01)

USPC ..... 200/81 R; 200/83 Q

(58) Field of Classification Search

CPC ..... H01H 35/24; H01H 35/00; H01H 33/00

USPC ..... 218/81 R, 81.9 R, 83 R, 83 WM, 83 A, 218/83 J, 83 Q

See application file for complete search history.

(56) References Cited

U.S. PATENT DOCUMENTS

| | | | | |
|---|---|---|---|---|
| 3,898,403 | A | 8/1975 | Grayson et al. | |
| 4,243,858 | A * | 1/1981 | Place | 200/83 P |
| 5,530,215 | A * | 6/1996 | Couvreur | 200/83 R |
| 7,718,907 | B2 | 5/2010 | Wildman | |
| 8,044,310 | B2 * | 10/2011 | Wildman | 200/81 R |

* cited by examiner

*Primary Examiner* — Amy Cohen Johnson
*Assistant Examiner* — Marina Fishman
(74) *Attorney, Agent, or Firm* — Shumaker, Loop & Kendrick, LLP

(57) ABSTRACT

A combination pressure switch including a pressure switch moveable between open and closed positions in response to a working pressure of a fluid, the pressure switch including a contact assembly having first and second terminals electrically connected through a current-carrying member movable by the pressure switch, and a manual switch configured to move the current-carrying member independent of the movement of the pressure switch.

14 Claims, 13 Drawing Sheets

COMBINATION PRESSURE SWITCH WITH MANUAL SHUTOFF

CROSS-REFERENCE TO RELATED APPLICATION

This application is a Continuation-in-Part Application claiming priority to U.S. patent application Ser. No. 12/173,834 filed Jul. 16, 2008 and entitled "COMBINATION PRESSURE SWITCH," the contents of which are incorporated by reference herein.

BACKGROUND

Valves and controls for air compressors and fluid handling systems are provided herein.

Fluid handling systems such as air compressors typically utilize a mechanically-driven pump, usually of the positive-displacement type. Usually, the pump is connected to a storage tank or manifold. The tank stores a working volume of air, which serves as a buffer so that the pump does not have to operate continuously. Instead, the pump is run until the tank is charged to a desired pressure, and then shut off until the pressure is depleted below a predetermined level. Pump cycling is controlled by a pressure-sensitive switch. Such systems usually also include an "unloader" valve, which is effective to vent the pressure on the pump head when the pump is not running. This feature greatly reduces the effort required to restart the pump for a subsequent cycle. In addition, prior art systems have a separate manual on/off switch, which increases complexity and cost. Prior art systems typically utilize the unloader valve, pressure switch and manual on/off switch as separate components, which increases complexity and cost.

BRIEF SUMMARY

In one embodiment, a combination pressure switch is provided herein including a pressure switch moveable between an open position and a closed position in response to a working pressure of a fluid, the pressure switch including a contact assembly including a first terminal, a second terminal, and a current-carrying member moveable between an open configuration electrically disconnecting the first and second terminals and a closed configuration electrically connecting the first and second terminals, wherein the current-carrying member is moved from the closed configuration to the open configuration by movement of the pressure switch to its open position in response to a working pressure of a fluid, and a manual switch configured to move the current-carrying member between its open and closed configurations independent of the movement of the pressure switch in response to a working pressure of a fluid.

In another aspect, the combination pressure switch optionally includes an unloader valve moveable between a closed position and an open position by at least one of movement of the pressure switch in response to a working pressure of a fluid and the manual switch.

In another aspect, the pressure switch and the unloader valve are axially misaligned within the combination pressure switch.

In another aspect, the movement of the unloader valve is mechanically linked to movement of the pressure switch through a lever.

In another aspect, the combination pressure switch further includes a housing, a pressure inlet in fluid communication with the pressure switch, and a vent inlet in fluid communication with the unloader valve.

In another aspect, the unloader valve includes a piston moveable within a bore formed in a body, the piston having a valve pin with upper and lower ends and an enlarged-diameter central portion defining a face that seats against a valve seat, a return spring disposed in the bore above the piston urging the piston in a direction of the valve seat, and a vent formed in the body that intersects the bore and forms a fluid connection between the vent inlet and exterior environment when the unloader valve is in its open position.

In another aspect, the pressure switch includes a disk-like separator that divides a chamber into upper and lower sections with the contact assembly in the upper section and an operating disk in the lower section that responds to a differential between atmospheric pressure and pressure in a pressure inlet.

In another aspect, the pressure switch includes an actuating pin that extends through an opening in a separator and moves up into contact with the current-carrying member in the open position of the pressure switch, and down into contact with an operating disk in the closed position of the pressure switch such that current carrying member electrically connects the first and second terminals.

In another aspect, the manual switch is a twist knob configured to impart rotational movement to a camshaft having a lobe positioned, such that, upon rotation of the camshaft, the lobe contacts and moves the current-carrying member to electrically disconnect the first and second terminals.

According to another embodiment, a combination pressure switch is provided herein including a pressure switch moveable between an open position and a closed position in response to a working pressure of a fluid, the pressure switch comprising a contact assembly including a first terminal, a second terminal, and a current-carrying member moveable between an open configuration electrically disconnecting the first and second terminals and a closed configuration electrically connecting the first and second terminals, wherein the current-carrying member is moved from the closed configuration to the open configuration by movement of the pressure switch to its open position in response to a working pressure of a fluid, an unloader valve moveable between a closed position and an open position by movement of the pressure switch in response to a working pressure of a fluid, and a manual switch configured to move the current-carrying member between its open and closed configurations and move the unloader from its closed position to its open position independent of the movement of the pressure switch in response to a working pressure of a fluid.

BRIEF DESCRIPTION OF THE DRAWINGS

The invention is understood by reference to the following description taken in conjunction with the accompanying drawing figures, in which.

DESCRIPTION OF THE EMBODIMENTS

Figure 2:
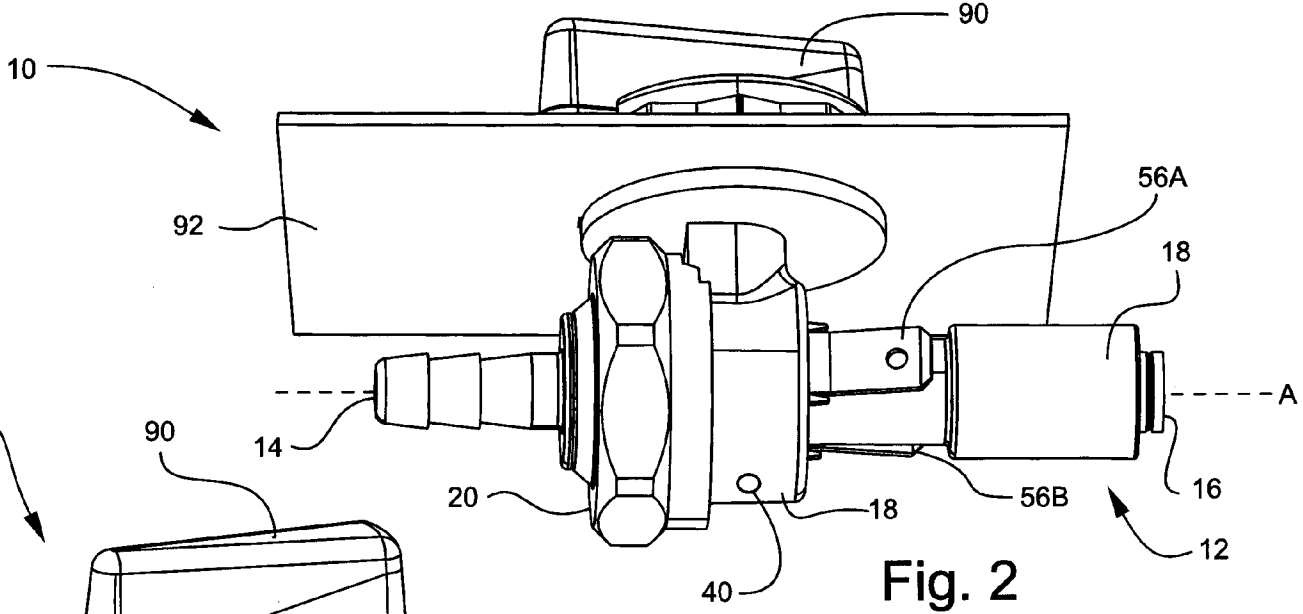
FIG. 2 is another perspective view of the combination switch of FIG. 1.
Figure 1:
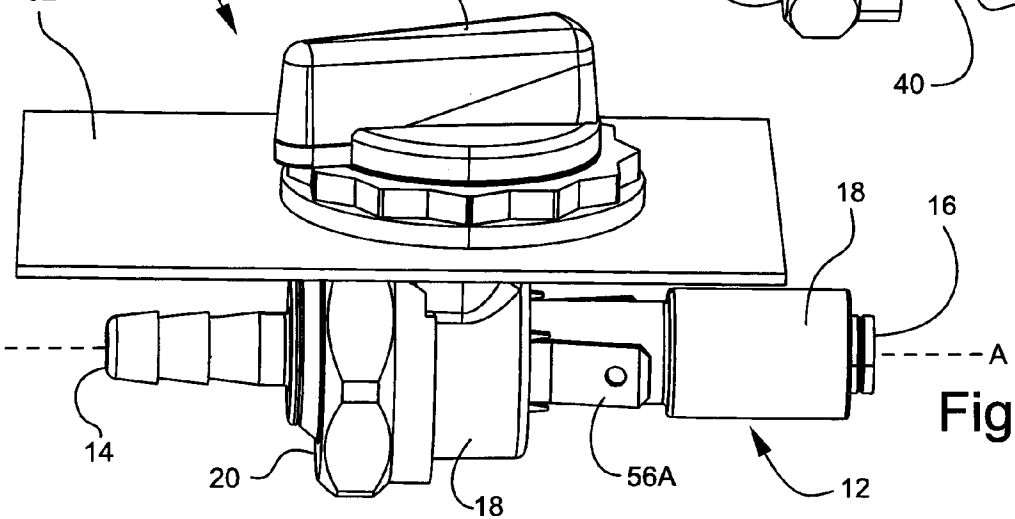
FIG. 1 is a perspective view of a first embodiment of a combination pressure switch.
Figure 3:
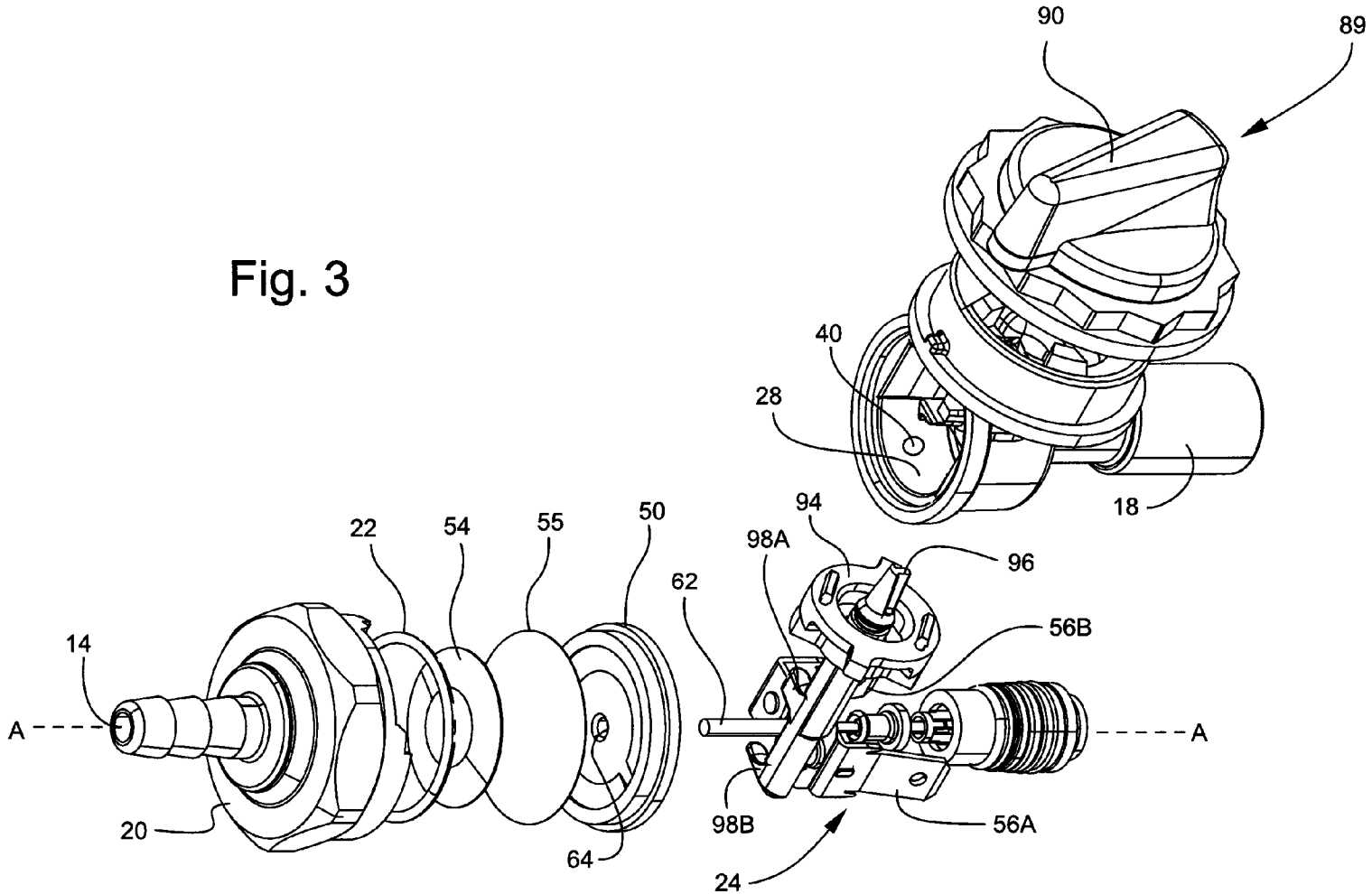
FIG. 3 is an exploded perspective view of the combination switch of FIG. 1.
Figure 4:
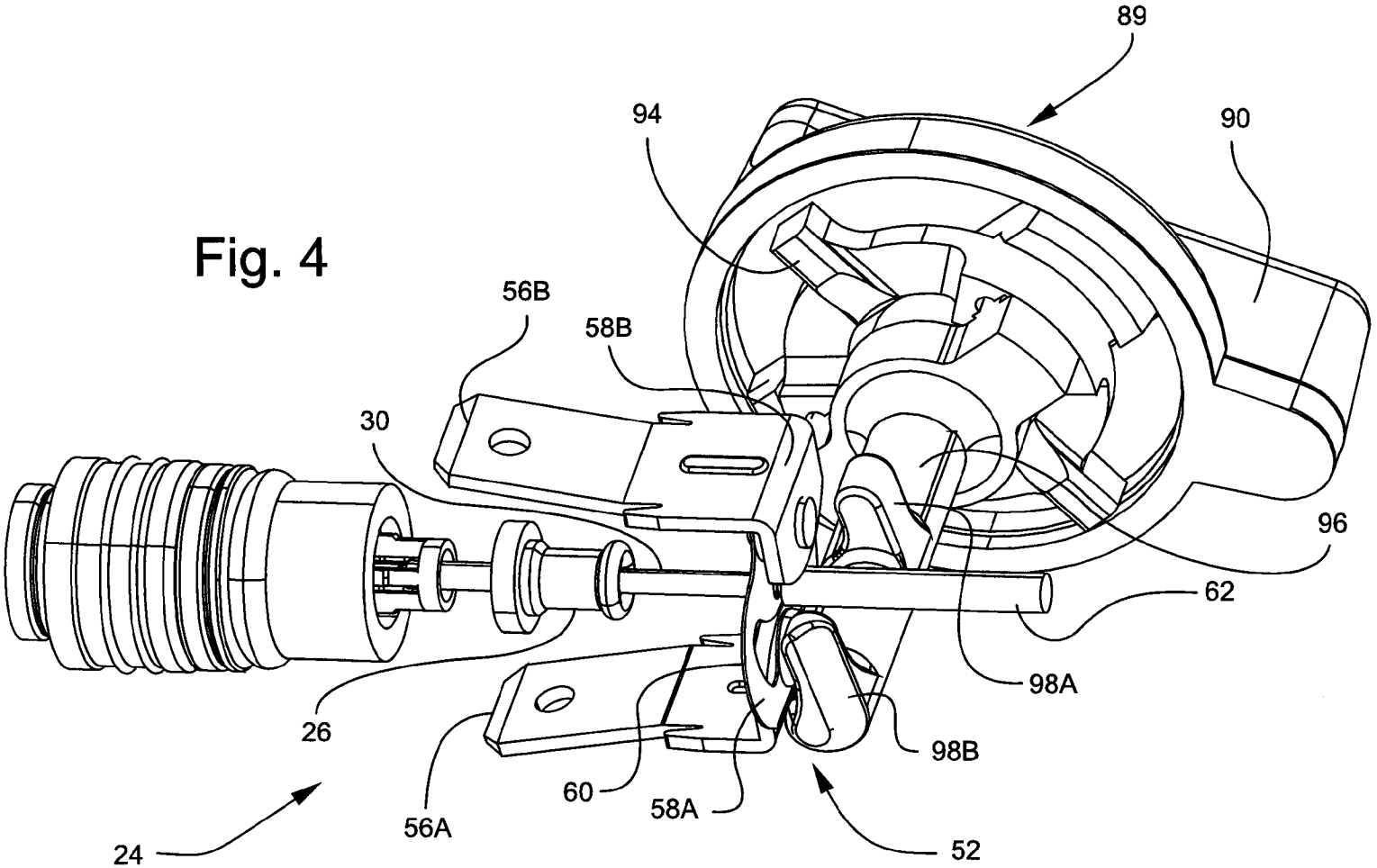
FIG. 4 is an exploded perspective view of the combination switch of FIG. 1.
Figure 5:
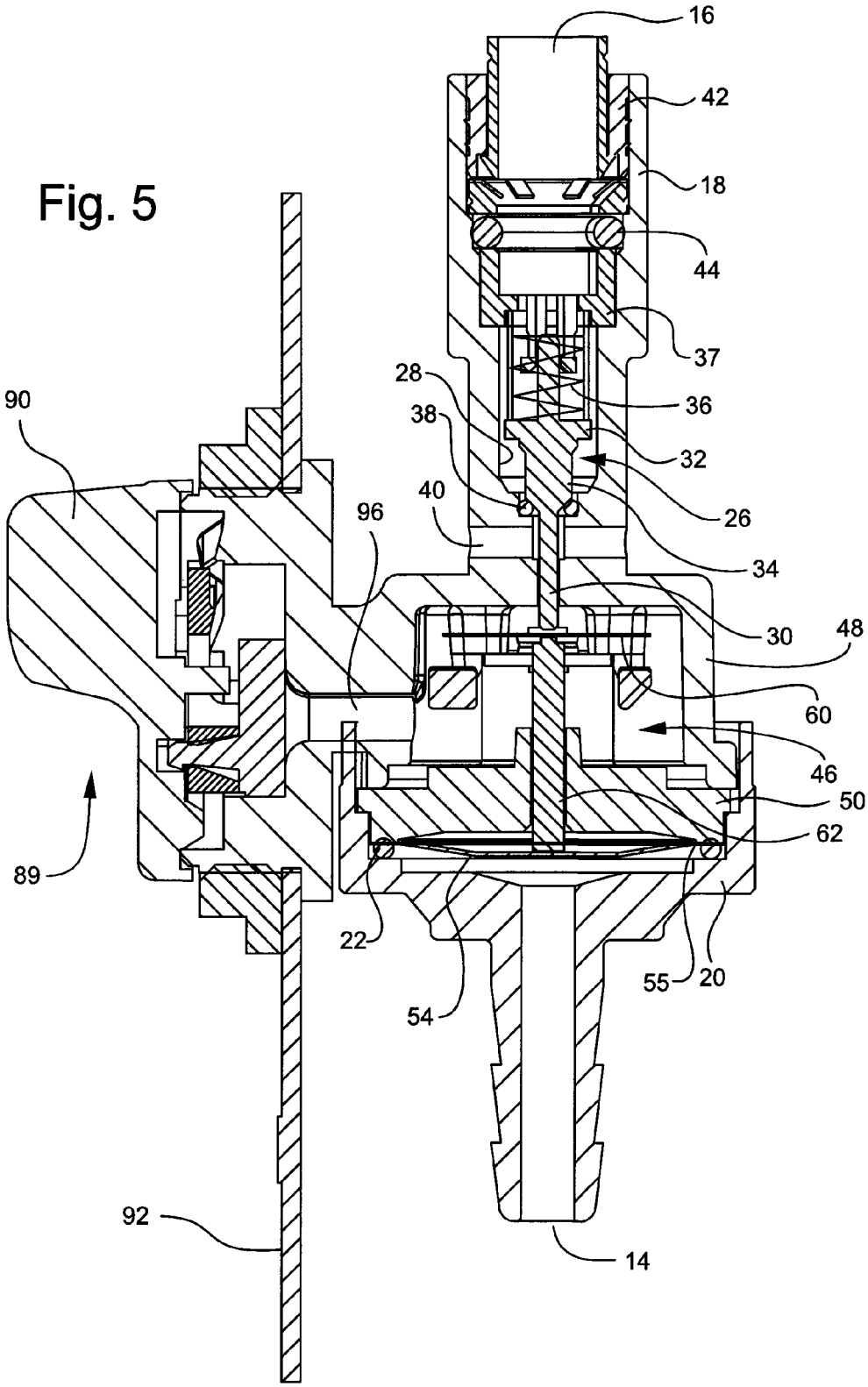
FIG. 5 is a cross-sectional view of the combination switch of FIG. 1.
Figure 6:
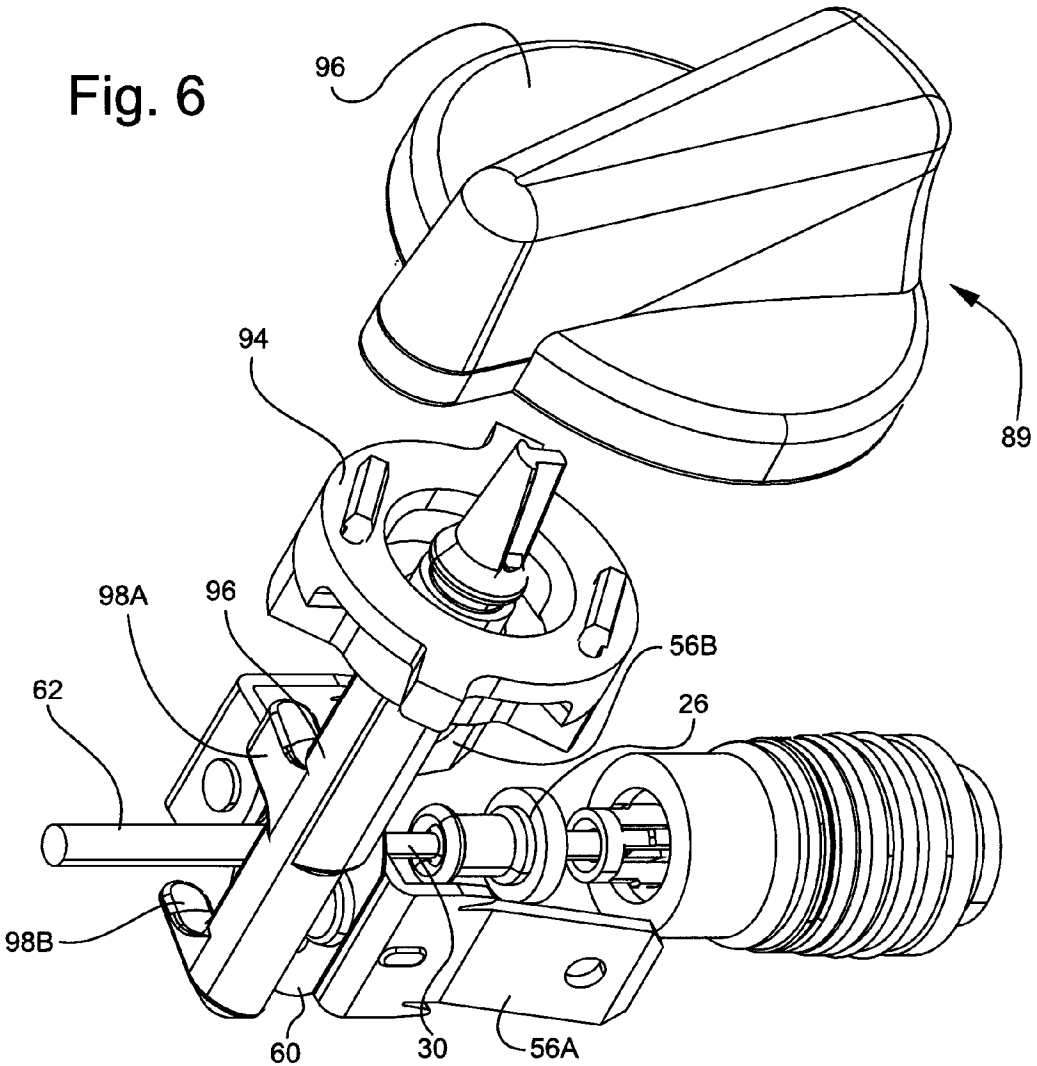
FIG. 6 is an exploded perspective view of the combination switch of FIG. 1.
Figure 8:
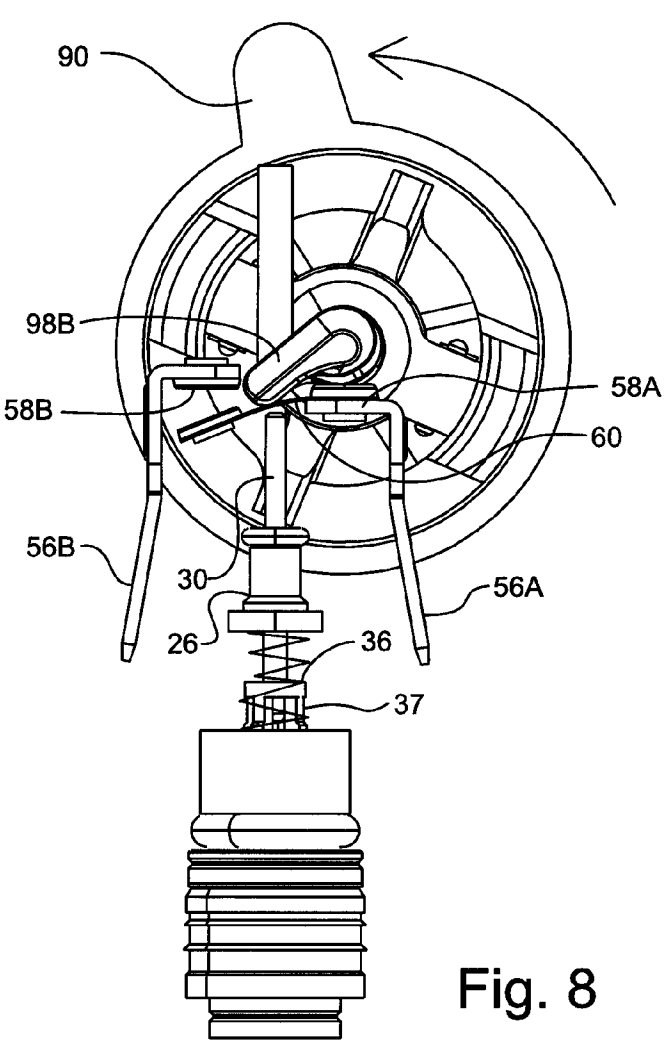
FIG. 8 is a bottom cross-sectional view of the combination switch of FIG. 1, wherein the electrical circuit is open.
Figure 7:
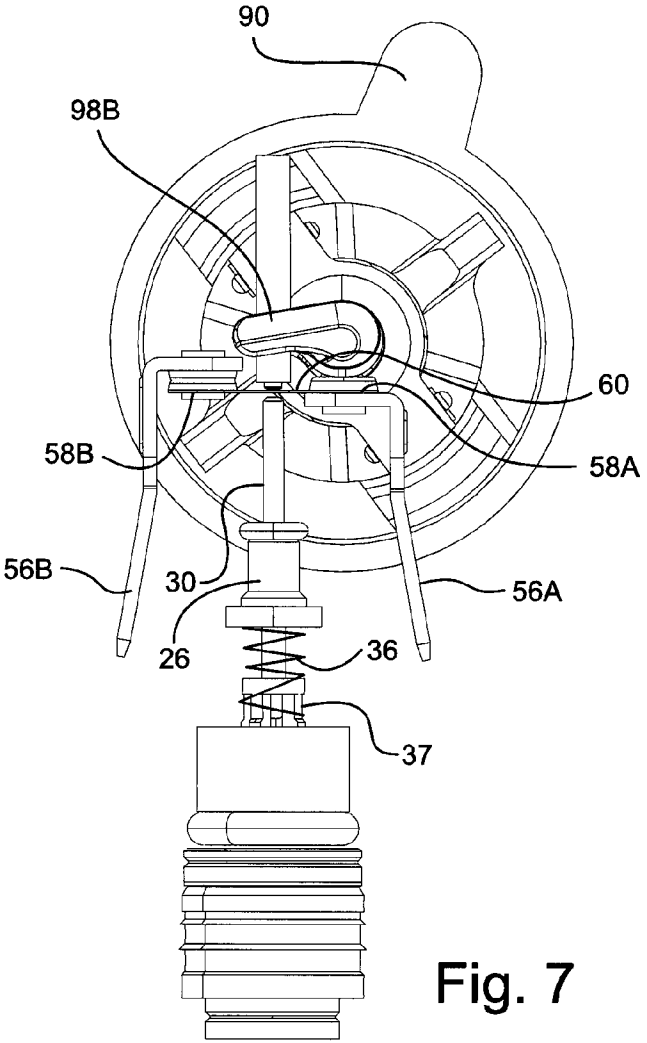
FIG. 7 is a bottom cross-sectional view of the combination switch of FIG. 1, wherein the electrical circuit is closed.

Referring to the drawings wherein identical reference numerals denote the same elements throughout the various views, FIGS. 1-8 illustrate a first embodiment of a combination pressure switch, referred to herein as the "combination switch," generally designated at reference number 10. The combination switch 10 includes a housing 12 with a longitudinal centerline or axis "A", a pressure inlet 14, and a vent inlet 16. In this embodiment, the housing 12 comprises a hollow, elongated body 18 that is closed off by a separate end cap 20. Leakage between the body 18 and the end cap 20 is prevented by a lower seal 22, for example an O-ring. The type of housing is not critical, and the internal components of the combination switch 10 could also be housed in a different structure, for example a manifold or a combination valve.

The combination switch 10 includes an unloader valve 24 having a piston 26 that moves inside a bore 28 formed in the body 18. The piston 26 has an elongated valve pin 30 with upper and lower ends, and an enlarged-diameter central portion 32 that defines a face 34. A return spring 36 is disposed in the bore 28 above the piston 26 and urges the piston 26 downward towards a closed position. A spring support 37 serves to locate the upper end of the valve pin 30 and the return spring 36. In the closed position, the face 34 seals against a valve seat 38, which in this example, is formed by a resilient O-ring. A vent 40 formed in the body 18 intersects the bore 28 and forms a fluid connection between the vent inlet 16 and the exterior environment when the unloader valve 24 is in a raised or "open" position. The upper end of the bore 28 is closed off by a hollow plug 42 that also forms the vent inlet 16. Any leakage between the bore 28 and the plug 42 is prevented by an upper seal 44, for example an O-ring.

A pressure switch 46 is disposed in the body 18 in a chamber 48 beneath the unloader valve 24. A disk-like separator 50 divides the chamber 48 into upper and lower sections. The pressure switch 46 comprises a contact assembly 52 in the upper section and an operating disk 54 in the lower section. The operating disk 54 is of a known type that responds to the differential between atmospheric pressure and the prevailing pressure in the pressure inlet 14. The operating disk 54 has an inherent preload and restoring force that causes it to move to a closed position when pressure is removed. Structurally, the operating disk 54 can be a so-called "snap disk" having a frustoconical shape with a flattened central portion that causes it to "snap" between its open and closed positions, which provides an avoid of "dead band" or hysteresis, so as to avoid "hunting" in operation. A flexible, gas-impermeable diaphragm 55 is trapped between the separator 50 and the lower seal 22, and seals off the pressure inlet 14 from the interior of the combination switch 10. The diaphragm 55 has a lower face in fluid communication with the pressure inlet 14, and an upper face in fluid communication with the vent 40.

The contact assembly 52 includes a first terminal 56A and a second terminal 56B that carry first and second contacts 58A and 58B, respectively. The first contact 58A is fixed and the second contact 58B is carried at the end of a moveable, electrically-conductive, current-carrying member. In the illustrated embodiment, the current-carrying member is a leaf spring 60 or "blade". The leaf spring 60 is biased to keep the contacts 58A and 58B together unless an external force is applied (i.e., the contact assembly 52 is normally "closed" in an electrical sense).

An actuating pin 62 extends through an opening 64 in the separator 50 and is free to move up and down along axis "A". The actuating pin 62 contacts both the operating disk 54 and the leaf spring 60, such that when the operating disk 54 is in a lower position, the contacts 58A and 58B touch each other, and when the operating disk 54 is in an upper position, the contacts 58A and 58B are separated, breaking the electrical flow path between the terminals 56A and 56B.

The lower end of the valve pin 30 of the piston 26 is positioned generally coaxially to the actuating pin 62, and touches the leaf spring 60, essentially forming a continuous linear mechanical path between the operating disk 54 and the piston 26. In this arrangement, when the operating disk 54 is in a lower position, piston 26 is in the "closed" position, and when the operating disk 54 is in an upper position, the piston 26 is in the "open" position. In alternate embodiments, a gap can be provided between the leaf spring 60 and the actuating pin 62 to provide a delayed actuation of the unloader valve.

A lever 89 is provided for manually operating the combination switch 10 and forming a manual on/off switch. The lever 89 is formed by a twist knob 90 mounted on a mounting panel 92 above the combination switch 10. The twist knob 90 is configured to impart rotational movement to a camshaft 96. The camshaft 96 is positioned within a lower housing 94 mounted to the bottom of the mounting panel 92. The camshaft 96 has a pair of lobes 98A and 98B located at a medial and distal end of the camshaft 96. The lobes 98A and 98B are positioned such that, upon rotation, the lobes 98A and 98B contact the current carrying member, in this case the leaf spring 60. As previously discussed, the leaf spring 60 acts to "close" an electrical contact formed by electrical terminals 56A and 56B by spanning the distance between contact points 58A and 58B. As the camshaft lobes 98A and 98B are rotated, the lobes contact the leaf spring 60 and displace the leaf spring 60 away from the contact point 58B until the circuit is "open" and current no longer runs through. As shown, 58A is the non-common terminal and is configured to be separated from the leaf spring 60. The leaf spring 60 is displaced until the valve pin 30 is contacted. The leaf spring 60 imparts linear movement to the valve pin 30, thus actuating the unloader valve 24 in the manner as previously set forth.

Figure 9:
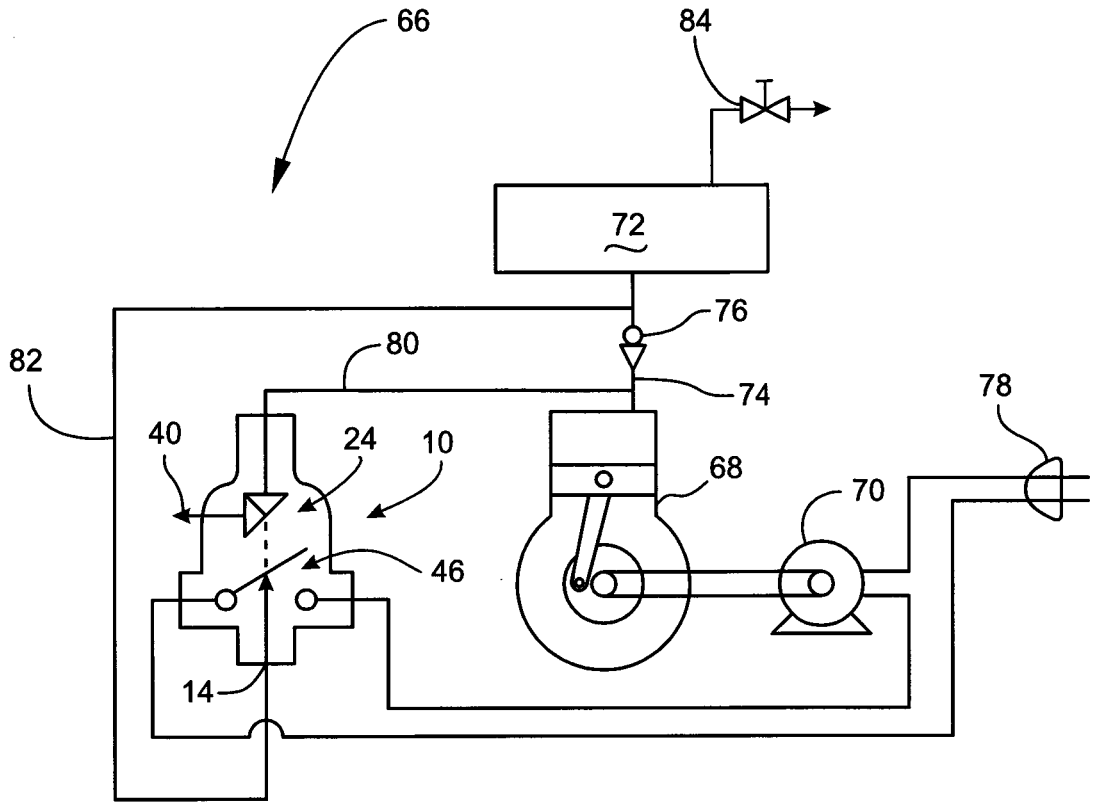
FIG. 9 is a schematic view of a pump system incorporating the combination switch of FIG. 1.
Figure 10:
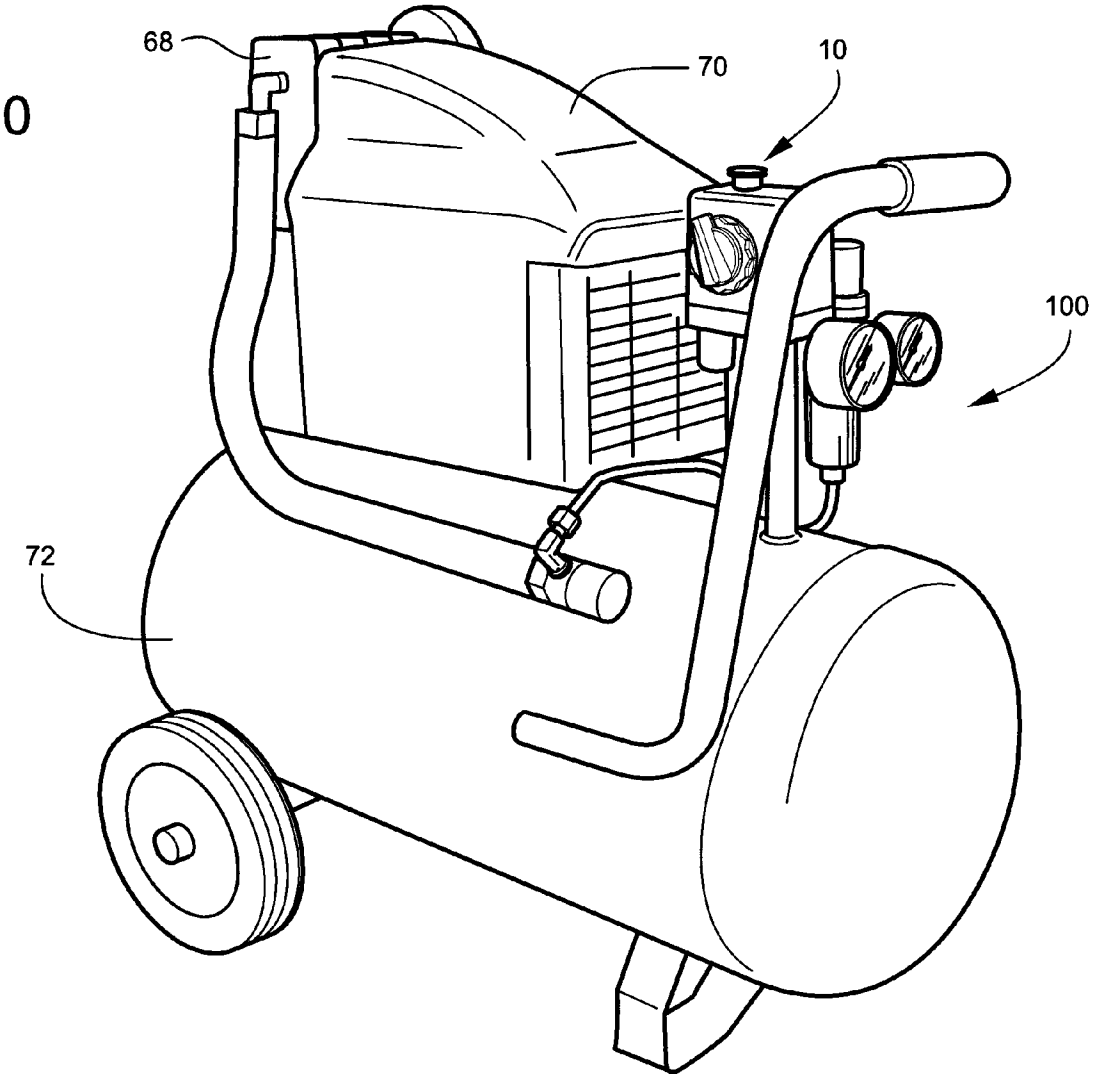
FIG. 10 is a perspective view of an air compressor incorporating the combination switch of FIG. 1.
Figure 11:
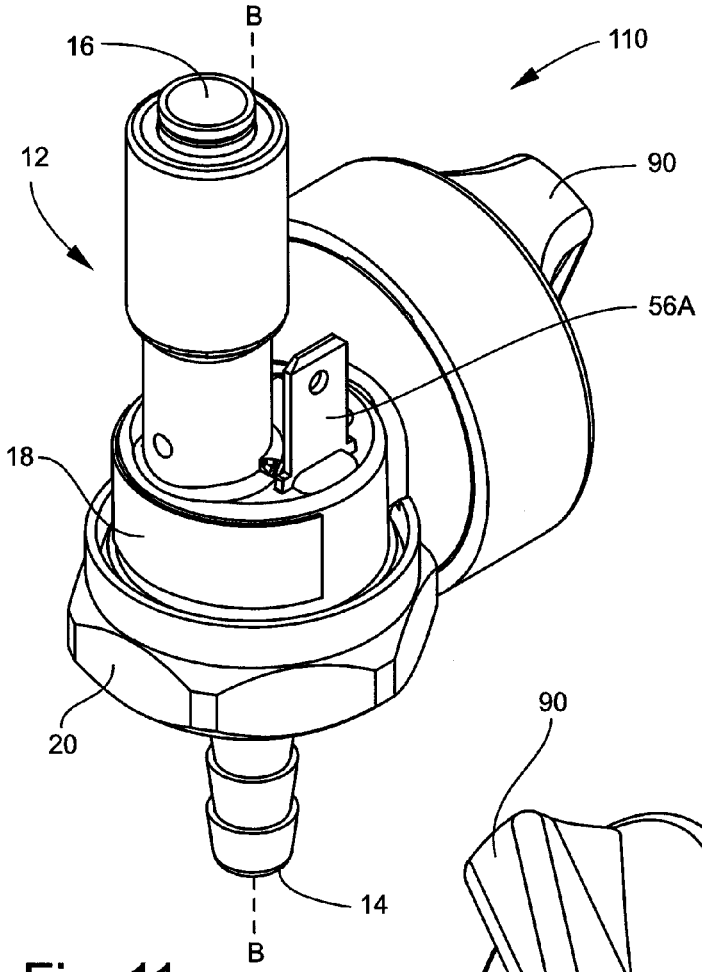
FIG. 11 is a perspective view of a second embodiment of a combination pressure switch.
Figure 12:
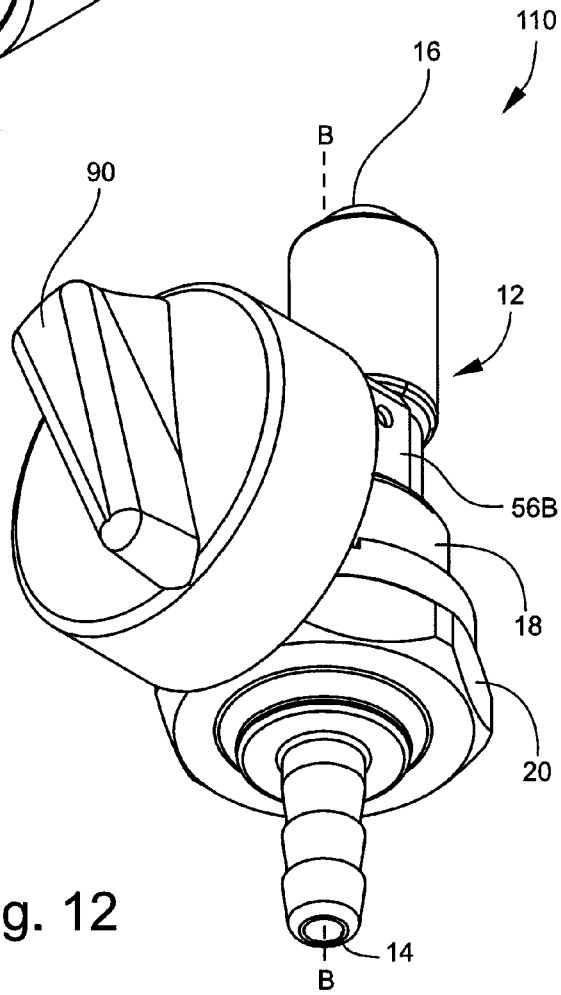
FIG. 12 is a perspective of the combination switch of FIG. 11.
Figure 13:
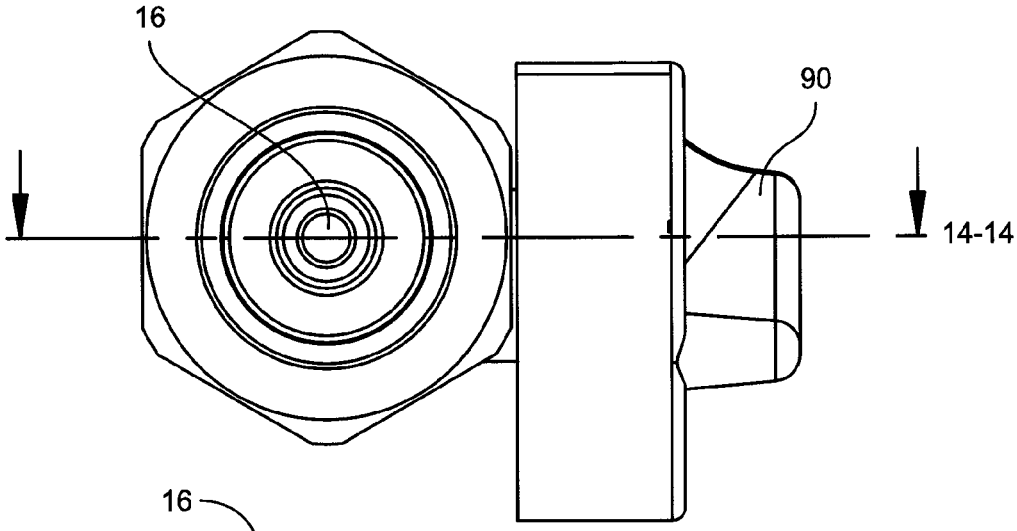
FIG. 13 is a top plan view of the combination switch of FIG. 11.
Figure 14:
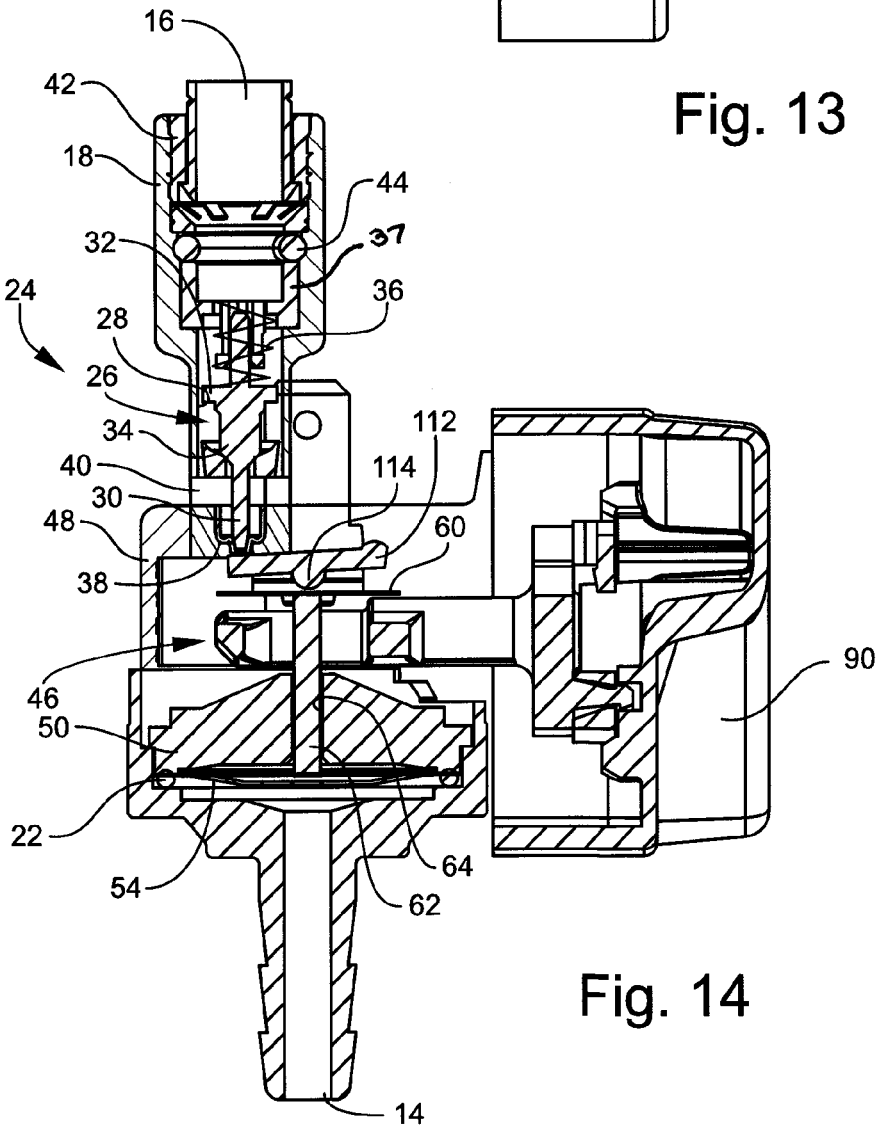
FIG. 14 is a cross-sectional view of the combination switch of FIG. 11 taken along line 14-14.
Figure 15:
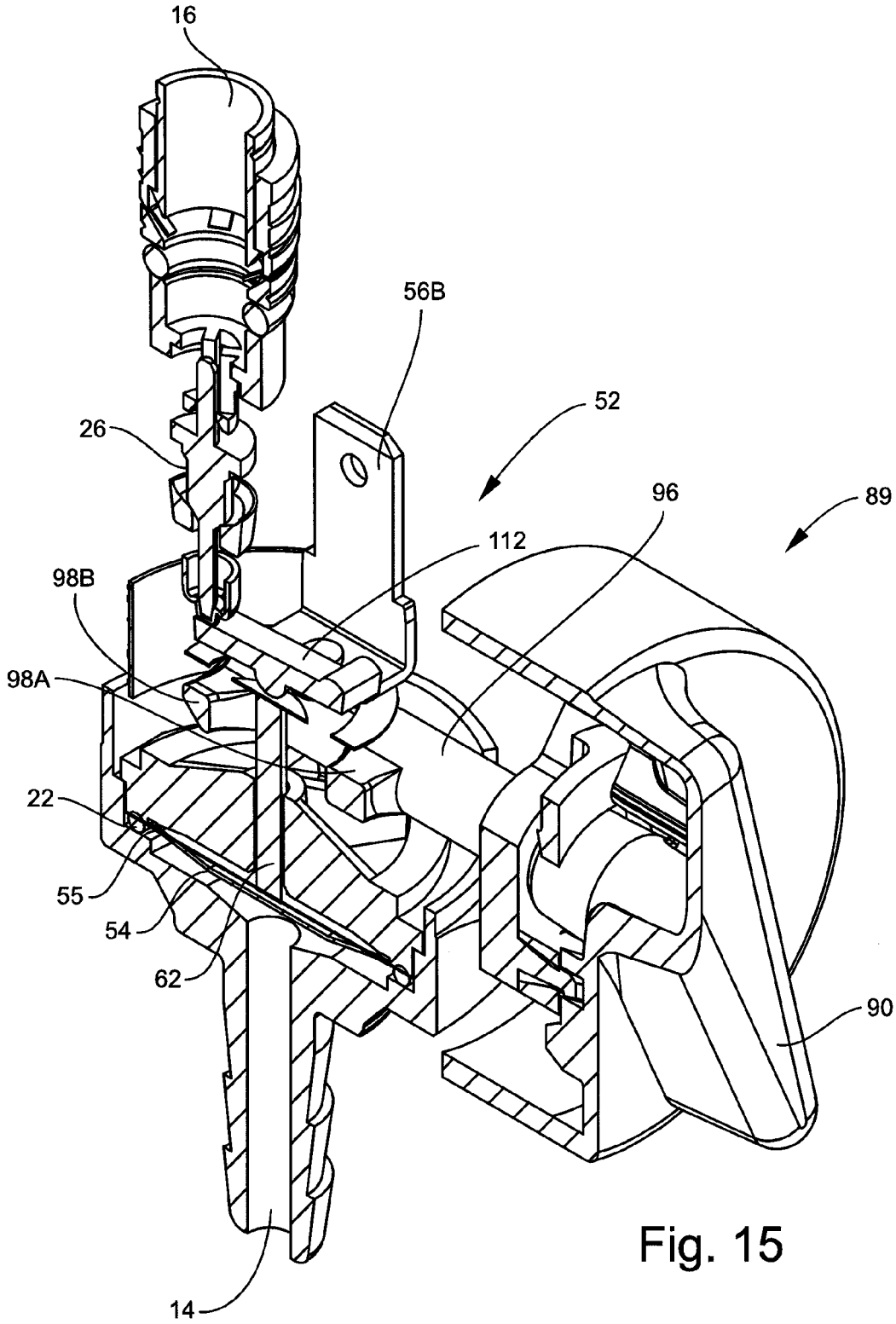
FIG. 15 is a cross-sectional perspective view of the combination switch of FIG. 11.
Figure 16:
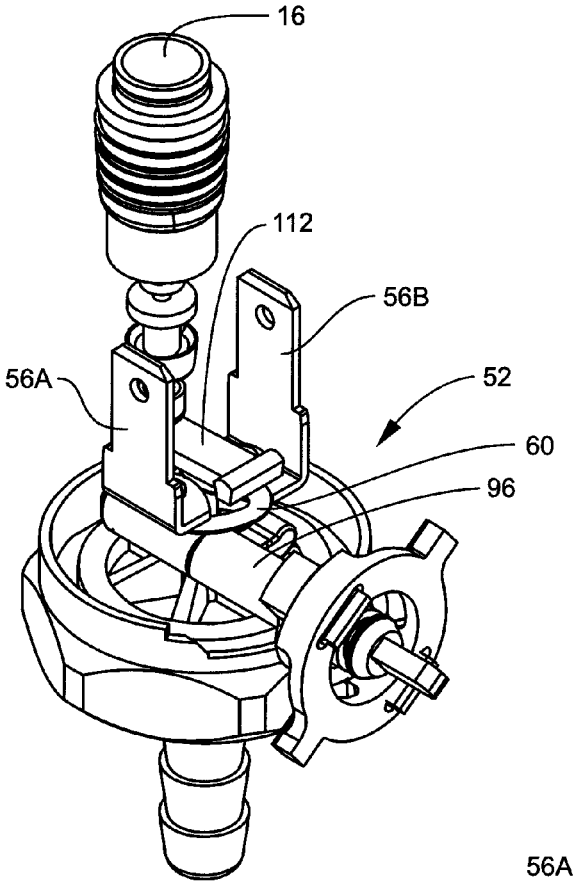
FIG. 16 is a perspective view of the combination switch of FIG. 11 showing the internal components.
Figure 17:
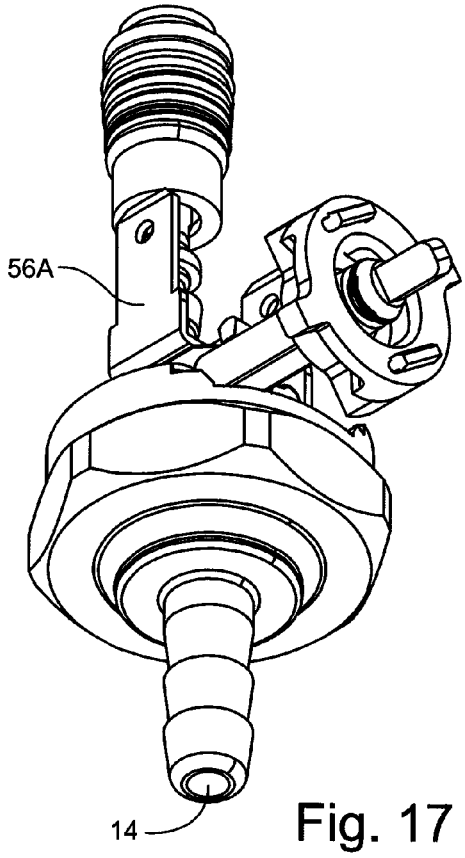
FIG. 17 is a perspective view of the combination switch of FIG. 11 showing the internal components.
Figure 19:
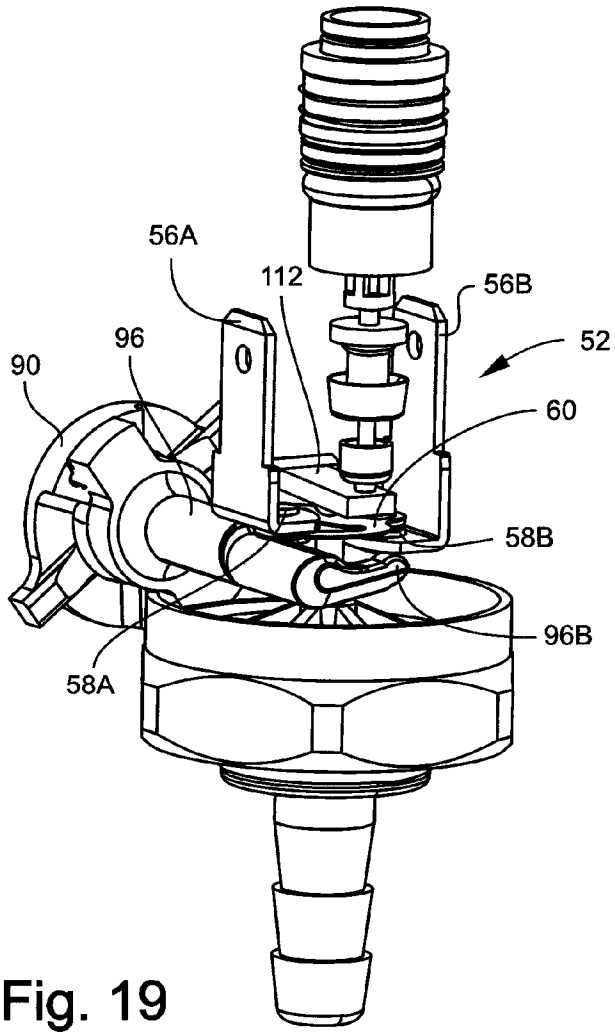
FIG. 19 is a perspective view of the combination switch of FIG. 11.
Figure 18:
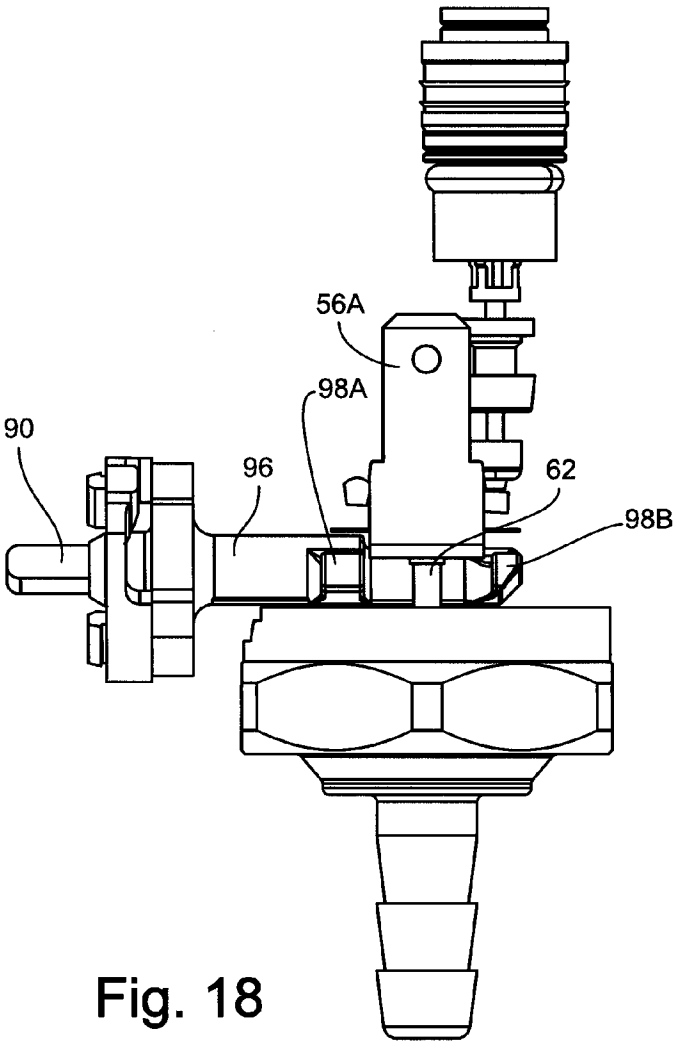
FIG. 18 is a side elevation view of the combination switch of FIG. 11.

FIG. 9 illustrates schematically a fluid handling system 66 utilizing the combination switch 10 of the present invention.

A practical example of such a system can be an air compressor for powering pneumatic tools and the like. The system generally includes a pump 68 driven by a motor 70, a storage tank 72 connected to the discharge side of the pump 68 through a discharge line 74 that includes a check valve 76, and the combination switch 10 described above. A power source 78 (e.g., main electrical supply) is connected to the motor 70 through the contacts of the pressure switch 46, and the discharge of the pump 68 is directly connected to the unloader valve 24 through a vent line 80. The storage tank 72 is connected to the pressure inlet 14 via a sensing line 82 connected downstream of the check valve 76. It is noted that FIG. 9 is intended to illustrate only the functional connections between the various components and not necessarily their structure, for example, in a practical air compressor the motor 70 is often coupled to the pump 68 with a direct shaft coupling rather than the illustrated belt.

The fluid handling system 66 would typically begin operation with the pressure inside the storage tank, denoted $P_{tank}$, at atmospheric pressure. $P_{tank}$ is communicated to the pressure switch 46 through the sensing line 80. When $P_{tank}$ is less than a set point pressure ($P_{set}$), the pressure switch 46 is closed. This also allows the unloader valve 24 to "close" against the valve seat 38 under pressure from the return spring 36.

In this condition, the motor 70 will operate the pump 68 to discharge air into the storage tank 72 through the discharge line and check valve 76, and consequently increase the pressure $P_{tank}$. When $P_{tank}$ reaches $P_{set}$, the pressure switch 46 will snap to the open position and stop the motor 70. The actuating pin 62 drives the unloader valve 24 open as described above. Any air pressure within the discharge line 74 upstream of the check valve 76 and the pump 68 is allowed to bleed to atmosphere along a path through the vent line 80, the unloader valve 24, and finally the vent 40. This relieves all pressure on the pump 68. The check valve 76 holds the pressure $P_{tank}$.

The unloader valve 24 and pressure switch 46 stay open as long as $P_{tank}$ is greater than $P_{set}$. Pressure is maintained in the storage tank 72 and can be discharged through an outlet 84 in a known manner, for example to a pneumatic tool. When $P_{tank}$ falls below $P_{set}$, the pressure switch 46 "closes", starting the pump 68, and allowing the unloader valve 24 to close under pressure from the return spring 36. This allows the pump 68 to charge the storage tank 72. The pressure switch 46 typically operates with some degree of "dead band" or hysteresis in the set point, in a known manner, so as to avoid excessive on-and-off cycling of the motor 70 and pump 68. For example, the $P_{set}$ needed to cause the motor 70 to cycle "off" may be substantially higher than the $P_{set}$ needed to cause the motor 70 to cycle "on".

Referring to FIGS. 11-19, a second embodiment of a combination pressure switch, referred to herein as the "combination switch," is shown generally at reference number 110. The combination switch 110 includes a housing 12, a pressure inlet 14, and a vent inlet 16. An axis "B" is centered with respect to the pressure inlet 14. The vent inlet 16, and consequentially the unloader valve 24, is laterally offset with respect to axis "B", thus, the unloader valve 24 and the pressure switch 46 are not in linear alignment as in the first embodiment. The housing 12 comprises a hollow, elongated body 18 that is closed off by a separate end cap 20. Leakage between the body 18 and the end cap 20 is prevented by a lower seal 22, such as an O-ring. The type of housing is not critical, and the internal components of the combination switch 110 could also be housed in a different structure, for example a manifold or a combination valve.

The combination switch 110 includes an unloader valve 24 having a piston 26 that moves inside a bore 28 formed in the body 18. The piston 26 has an elongated valve pin 30 with upper and lower ends, and an enlarged-diameter central portion 32 that defines a face 34. A return spring 36 is disposed in the bore 28 above the piston 26 and urges the piston 26 downward towards a closed position. A spring support 37 serves to locate the upper end of the valve pin 30 and the return spring 36. In the closed position, the face 34 seals against a valve seat 38. A vent 40 formed in the body 18 intersects the bore 28 and forms a fluid connection between the vent inlet 16 and the exterior environment when the unloader valve 24 is in a raised or "open" position. The upper end of the bore 28 is closed off by a hollow plug 42 that also forms the vent inlet 16. Any leakage between the bore 28 and the plug 42 is prevented by an upper seal 44, such as the illustrated O-ring. The unloader valve 24 is optional and may or may not be included in the switch 110.

A pressure switch 46 is disposed in the body 18 in a chamber 48, beneath the unloader valve 24. A disk-like separator 50 divides the chamber 48 into upper and lower sections. The pressure switch 46 comprises a contact assembly 52 in the upper section and an operating disk 54 in the lower section. The operating disk 54 is of a known type that responds to the differential between atmospheric pressure and the prevailing pressure in the pressure inlet 14. The operating disk 54 has an inherent preload and restoring force that causes it to move to a closed position when pressure is removed. Structurally, the operating disk 54 can be a so-called "snap disk" having a frustoconical shape with a flattened central portion that causes it to "snap" between its open and closed positions. This provides an amount of "dead band" or hysteresis, so as to avoid "hunting" in operation. A flexible, gas-impermeable diaphragm 55 is trapped between the separator 50 and the lower seal 22, and seals off the pressure inlet 14 from the interior of the combination switch 110. The diaphragm 55 has a lower face in fluid communication with the pressure inlet 14, and an upper face in fluid communication with the vent 40.

The contact assembly 52 includes a first terminal 56A and a second terminal 56B that carry first and second contacts 58A and 58B, respectively. The first contact 58A is fixed and the second contact 58B is carried on a moveable, electrically-conductive, current-carrying member. In the illustrated embodiment, the current-carrying member is a resilient leaf spring 60 or "blade". The leaf spring 60 is biased to keep the contacts 58A and 58B together unless an external force is applied (i.e., the contact assembly 52 is normally "closed" in an electrical sense).

An actuating pin 62 extends through an opening 64 in the separator 50 and is free to move up and down along axis "B". The actuating pin 62 contacts both the operating disk 54 and the leaf spring 60, such that when the operating disk 54 is in a lower position, the contacts 58A and 58B touch each other, and when the operating disk 54 is in an upper position, the contacts 58A and 58B are separated, breaking the electrical flow path between the terminals 56A and 56B.

The contact assembly further includes a lever 112 that pivots about a fulcrum 114. One end of the lever 112 moves up into contact with the valve pin 30 to open the unloader valve 24 when the operating disk 54 opens and the actuating pin 52 moves upward. The lever 112 provides a lever arm sufficient to generate the force required to move the valve pin 30 upwards to its "open" position.

The lower end of the valve pin 30 of the piston 26 is axially offset relative to the actuating pin 62 and touches the lever 112, forming a non-linear mechanical path between the operating disk 54 and the piston 26. In this arrangement, when the operating disk 54 is in a lower position, piston 26 is in the "closed" position, and when the operating disk 54 is in an upper position, the piston 26 is in the "open" position. In alternate embodiments, a gap can be provided between the leaf spring 60 and the actuating pin 62 to provide a delayed actuation of the unloader valve.

A lever 89 is provided for manually operating the combination switch 110 and forming a manual on/off switch. Thus, the combination switch 110 includes both automatic shut-off by the pressure switch 46 that opens the contact and the unloader valve 24, as well as a manual lever 89 that opens the switch and the unloader valve 24. The lever 89 is formed as a twist knob 90 mounted to the side of the housing 12. The twist knob 90 is configured to impart rotational movement to a camshaft 96. The camshaft 96 has a pair of lobes 98A and 98B located at a medial and distal end of the camshaft 96. The lobes 98A and 98B are positioned such that, upon rotation, the lobes 98A and 98B contact and move the leaf spring 60 or "blade" and "open" the switch. As previously discussed, the leaf spring 60 acts to "close" an electrical contact formed by electrical terminals 56A and 56B by spanning the distance between contact points 58A and 58B. As the camshaft lobes 98A and 98B are rotated, the lobes contact the leaf spring 60 and displace the leaf spring 60 away from the contact point 58B until the circuit is "open," and current no longer runs through. The leaf spring 60 is displaced until the lever 112 moves upward and contacts the valve pin 30. The movement of the leaf spring 60 imparts pivoting movement to the lever 112, which imparts linear movement to the valve pin 30, thus opening the unloader valve 24 in the manner as previously set forth.

The second embodiment of the combination switch 110 can be utilized in the fluid handling system 66 shown in FIG. 9 in place of combination switch 10.

The foregoing is a description of various embodiments of a combination pressure switch including a manual on/off switch. It is envisioned that various modifications can be made to the switch by those skilled in the art, and that those modifications are intended to be covered by the claims.

What is claimed is:

1. A combination pressure switch, comprising:

a pressure switch arranged along a first axis and moveable between an open position and a closed position in response to a working pressure of a fluid, the pressure switch comprising a contact assembly including a first terminal, a second terminal, and a current-carrying member moveable between an open configuration electrically disconnecting the first and second terminals and a closed configuration electrically connecting the first and second terminals, wherein the current-carrying member is moved from the closed configuration to the open configuration by movement of the pressure switch to its open position in response to a working pressure of a fluid;

a manual switch configured to move the current-carrying member between its open and closed configurations independent of the movement of the pressure switch in response to a working pressure of a fluid; and an unloader valve arranged along a second axis and moveable between a closed position and an open position by at least one of movement of the pressure switch in response to a working pressure of a fluid and the manual switch; and wherein the first axis and the second axis are parallel and axially offset.

2. The combination pressure switch according to claim 1, wherein movement of the unloader valve is mechanically linked to movement of the pressure switch through a lever.

3. The combination pressure switch according to claim 1, further comprising:

a housing;

a pressure inlet in fluid communication with the pressure switch; and a vent inlet in fluid communication with the unloader valve.

4. The combination pressure switch according to claim 3, wherein the unloader valve comprises:

a piston moveable within a bore formed in a body, the piston having a valve pin with upper and lower ends and an enlarged-diameter central portion defining a face that seats against a valve seat;

a return spring disposed in the bore above the piston urging the piston in a direction of the valve seat; and a vent formed in the body that intersects the bore and forms a fluid connection between the vent inlet and exterior environment when the unloader valve is in its open position.

5. The combination pressure switch according to claim 1, wherein the pressure switch comprises a disk-like separator that divides a chamber into upper and lower sections with the contact assembly in the upper section and an operating disk in the lower section that responds to a differential between atmospheric pressure and pressure in a pressure inlet.

6. The combination pressure switch according to claim 1, wherein the pressure switch comprises an actuating pin that extends through an opening in a separator and moves up into contact with the current-carrying member in the open position of the pressure switch, and down into contact with an operating disk in the closed position of the pressure switch such that current carrying member electrically connects the first and second terminals.

7. The combination pressure switch according to claim 1, wherein the manual switch is a twist knob configured to impart rotational movement to a camshaft having a lobe positioned, such that, upon rotation of the camshaft, the lobe contacts and moves the current-carrying member to electrically disconnect the first and second terminals.

8. A combination pressure switch, comprising:

a pressure switch arranged along a first axis and moveable between an open position and a closed position in response to a working pressure of a fluid, the pressure switch comprising a contact assembly including a first terminal, a second terminal, and a current-carrying member moveable between an open configuration electrically disconnecting the first and second terminals and a closed configuration electrically connecting the first and second terminals, wherein the current-carrying member is moved from the closed configuration to the open configuration by movement of the pressure switch to its open position in response to a working pressure of a fluid;

an unloader valve arranged along a second axis and moveable between a closed position and an open position by movement of the pressure switch in response to a working pressure of a fluid; and a manual switch configured to move the current-carrying member between its open and closed configurations and move the unloader from its closed position to its open position independent of the movement of the pressure switch in response to a working pressure of a fluid; and wherein the first axis and the second axis are parallel and axially offset.

9. The combination pressure switch according to claim 8, wherein movement of the unloader valve is mechanically linked to movement of the pressure switch through a lever.

10. The combination pressure switch according to claim 8, further comprising:

a housing;

a pressure inlet in fluid communication with the pressure switch; and a vent inlet in fluid communication with the unloader valve.

11. The combination pressure switch according to claim 10, wherein the unloader valve comprises:

a piston moveable within a bore formed in a body, the piston having a valve pin with upper and lower ends and an enlarged-diameter central portion defining a face that seats against a valve seat;

a return spring disposed in the bore above the piston urging the piston in a direction of the valve seat; and a vent formed in the body that intersects the bore and forms a fluid connection between the vent inlet and exterior environment when the unloader valve is in its open position.

12. The combination pressure switch according to claim 8, wherein the pressure switch comprises a disk-like separator that divides a chamber into upper and lower sections with the contact assembly in the upper section and an operating disk in the lower section that responds to a differential between atmospheric pressure and pressure in a pressure inlet.

13. The combination pressure switch according to claim 8, wherein the pressure switch comprises an actuating pin that extends through an opening in a separator and moves up into contact with the current-carrying member in the open position of the pressure switch, and down into contact with an operating disk in the closed position of the pressure switch such that current carrying member electrically connects the first and second terminals.

14. The combination pressure switch according to claim 8, wherein the manual switch is a twist knob configured to impart rotational movement to a camshaft having a lobe positioned, such that, upon rotation of the camshaft, the lobe contacts and moves the current-carrying member to electrically disconnect the first and second terminals.

* * * * *